US006632165B1

(12) United States Patent
Letourneau et al.

(10) Patent No.: US 6,632,165 B1
(45) Date of Patent: Oct. 14, 2003

(54) PAPER CONVERSION DISPENSER MACHINE

(76) Inventors: Guy Letourneau, 5091 Hertel, Pierrefonds, QC (CA), H8Z 2S2; Howard Selinger, 103 Marie-Curie, Dollard-des-Ormeaux, QC (CA), H9A 3C5

( * ) Notice: Subject to any disclaimer, the term of this patent is extended or adjusted under 35 U.S.C. 154(b) by 107 days.

(21) Appl. No.: 09/702,608

(22) Filed: Nov. 1, 2000

(51) Int. Cl.[7] ..... B31F 7/00
(52) U.S. Cl. ..... 493/464
(58) Field of Search ..... 493/464, 967; 242/615.3, 615.2; 226/189

(56) References Cited

U.S. PATENT DOCUMENTS

| | | | | | |
|---|---|---|---|---|---|
| 3,655,500 | A | * | 4/1972 | Johnson | 206/521 |
| 3,974,953 | A | * | 8/1976 | Klose | 156/406 |
| 4,557,716 | A | | 12/1985 | Ottaviano | |
| 4,650,456 | A | | 3/1987 | Armington et al. | |
| 5,114,063 | A | * | 5/1992 | Vukelich | 226/168 |
| 5,123,889 | A | | 6/1992 | Armington et al. | |
| 5,131,903 | A | | 7/1992 | Levine et al. | |
| 5,468,208 | A | | 11/1995 | Armington et al. | |
| 5,569,146 | A | | 10/1996 | Simmons | |
| 5,593,376 | A | * | 1/1997 | Armington et al. | 493/346 |
| 5,607,383 | A | | 3/1997 | Armington et al. | |
| 5,637,071 | A | | 6/1997 | Simmons et al. | |
| 5,643,167 | A | | 7/1997 | Simmons | |
| 5,681,255 | A | | 10/1997 | Simmons | |
| 5,749,824 | A | | 5/1998 | Guth | |
| 5,755,656 | A | | 5/1998 | Beierlorzer | |
| 5,807,229 | A | | 9/1998 | Febel | |
| 5,813,967 | A | | 9/1998 | Davila | |
| 5,816,995 | A | | 10/1998 | Tekavec et al. | |
| 5,873,809 | A | | 2/1999 | Kempster et al. | |
| 5,891,009 | A | | 4/1999 | Ratzel et al. | |
| 5,915,611 | A | * | 6/1999 | Baldoni et al. | 226/172 |
| 6,117,062 | A | * | 9/2000 | Alhamad | 493/363 |
| 6,176,818 | B1 | * | 1/2001 | Simmons et al. | 493/346 |
| 6,179,765 | B1 | * | 1/2001 | Toth | 493/360 |
| 6,200,251 | B1 | * | 3/2001 | Harding et al. | 493/464 |
| 6,273,360 | B1 | * | 8/2001 | Robinson | 242/571.5 |
| 6,416,451 | B1 | * | 7/2002 | Ratzel et al. | 493/38 |

* cited by examiner

*Primary Examiner*—Eugene Kim
*Assistant Examiner*—Brian Nash
(74) *Attorney, Agent, or Firm*—Collard & Roe, P.C.

(57) ABSTRACT

A paper conversion dispenser machine for converting sheet-like material into a relatively low density cushioning dunnage product. The machine has a stock supplying assembly that supplies at least one stock paper roll, a shaping member for crumpling and converting sheet-like material of the roll(s) into a three-dimensional shape that consists of a pre-entry section with two side entry guiding rollers for guiding and reducing the sheet-like material of a supplied width to a narrower width non linear crumpled stream of paper, and an entry section with two side entry rollers to guide and reduce the crumpled down stream of paper to an even narrower width relatively low density cushioning dunnage product. The machine also has a guiding tunnel of a substantially uniform cross section, a feed mechanism with driving rollers for driving the stock material through the shaping member, and an automatic cutting set for cutting the dunnage product.

12 Claims, 5 Drawing Sheets

PAPER CONVERSION DISPENSER MACHINE

FIELD OF THE INVENTION

The invention relates generally to a paper conversion machine, more particularly to a dunnage dispensing machine that reduces a flexible stock sheet-like roll material of a supplied width into a narrower crumpled paper; and dispenses the latter directly into a shipping case or box containing fragile goods for protection in the form of dunnage and/or void fill product.

BACKGROUND OF THE INVENTION

Protective packaging material is used in every shipping process to fill voids and protect products by cushioning.

Commonly used protective packaging material consists of plastic bubble rolls, liquid foam injection molding and polystyrene loose fill. These plastic packaging materials are not biodegradable and it has become increasingly important in light of many industries adopting more progressive policies in terms of environmental responsibility.

The forgoing and other disadvantages of conventional plastic packaging materials have made paper protective packaging material a very popular alternative. One form of paper dunnage, which is very well known in the art, is provided in a relatively low density cushioning material obtained from flexible sheet-like paper using a cushioning conversion machine.

U.S. Pat. Nos. 5,607,383 and 5,593,376 to Armington et al, are representative of a large group of Patents disclosing a modular cushioning conversion machine. The disclose cushioning conversion machines for producing a dunnage product from supplied sheet-like stock material, for example, in roll form, and more particularly, to an improved modular construction of such machine.

U.S. Pat. No. 5,131,903 to Levine et al., discloses an apparatus for crumpling and dispensing dunnage from a roll of flexible, stock paper material, and more particularly, to a disposable, dunnage dispensing apparatus which structurally reinforces its outer housing and that maintains a length of dunnage dispensed therefrom in a crumpled state.

In machines of the above-described type there is considerable friction between the moving dunnage product and the different parts of the machine. The friction becomes more severe in places where the width of the strip is significantly reduced, thus causing increased relative tension acting on the strip and, as a result, wears the strip off. Consequently, the effective machine productivity and reliability are well affected.

OBJECTS OF THE INVENTION

An object of the present invention is to provide a paper conversion dispenser machine that obviates the above-mentioned disadvantages.

Another object of the present invention is to provide a paper conversion dispenser machine that is extremely reliable to use.

A further object of the present invention is to provide a paper conversion dispenser machine that is relatively simple to produce.

Yet another object of the present invention is to provide a paper conversion dispenser machine that is essentially friction free at the paper shaping member, especially at the pre-entry section where the paper is first significantly reduced in width.

Still another object of the present invention is to provide a paper conversion dispenser machine that is capable of producing crumpled stream of paper at relatively high rate.

Other objects and advantages of the present invention will become apparent from a careful reading of the detailed description provided herein, with appropriate reference to the accompanying drawings.

SUMMARY OF THE INVENTION

A paper conversion dispenser machine for converting sheet-like material into a relatively low density cushioning dunnage product, said machine comprises a frame adapted to support a stock supplying assembly for supplying at least one stock paper roll, a shaping member for crumpling and converting sheet-like material of said roll into a three-dimensional shape, said shaping member including a pre-entry section with two side entry guiding rollers having a substantially vertical axis for guiding and reducing said sheet-like material of a supplied width to a narrower width non linear crumpled stream of paper, and an entry section for guiding and reducing said crumpled stream down to an even narrower width relatively low density cushioning dunnage product, a guiding tunnel having a substantially uniform cross section, a feed mechanism for driving said stock paper roll through said shaping member and a cutting set for cutting said dunnage product.

Preferably, each of the side entry guiding rollers is pivotally mounted at a lower end to allow for inclination adjustment of the same about their respective vertical axis.

Preferably, the inclination adjustment occurs within a plane defined by said axis of said two side entry guiding rollers.

Preferably, the entry section includes two side entry guiding rollers having a substantially vertical axis.

Preferably, each of the pre-entry and entry sections includes a bottom mounted roller having a respective substantially horizontal axis.

Preferably, the rollers are covered with an anti-friction material.

Preferably, the feed mechanism has a driving roller and a driven roller spring biased against said driving roller, said driving and driven rollers being adapted to frictionally receive said dunnage product therebetween.

Preferably, each of said driving and driven roller is made out of two coaxial wheels.

Preferably, the pre-entry section is slidably mounted to said frame via an attachment member.

Preferably, the stock supplying assembly includes two stock paper rolls parallel to each other.

Preferably, the pre-entry and entry sections reduce said at least one stock paper roll entering the same by approximately 70% and 30% in width respectively.

BRIEF DESCRIPTION OF THE DRAWINGS

In the annexed drawings, like reference characters indicate like elements throughout.

DETAILED DESCRIPTION OF THE PREFERRED EMBODIMENT

With reference to the annexed drawing the preferred embodiment of the present invention will be herein described for indicative purposes and by no means as of a limitation.

Figure 1:
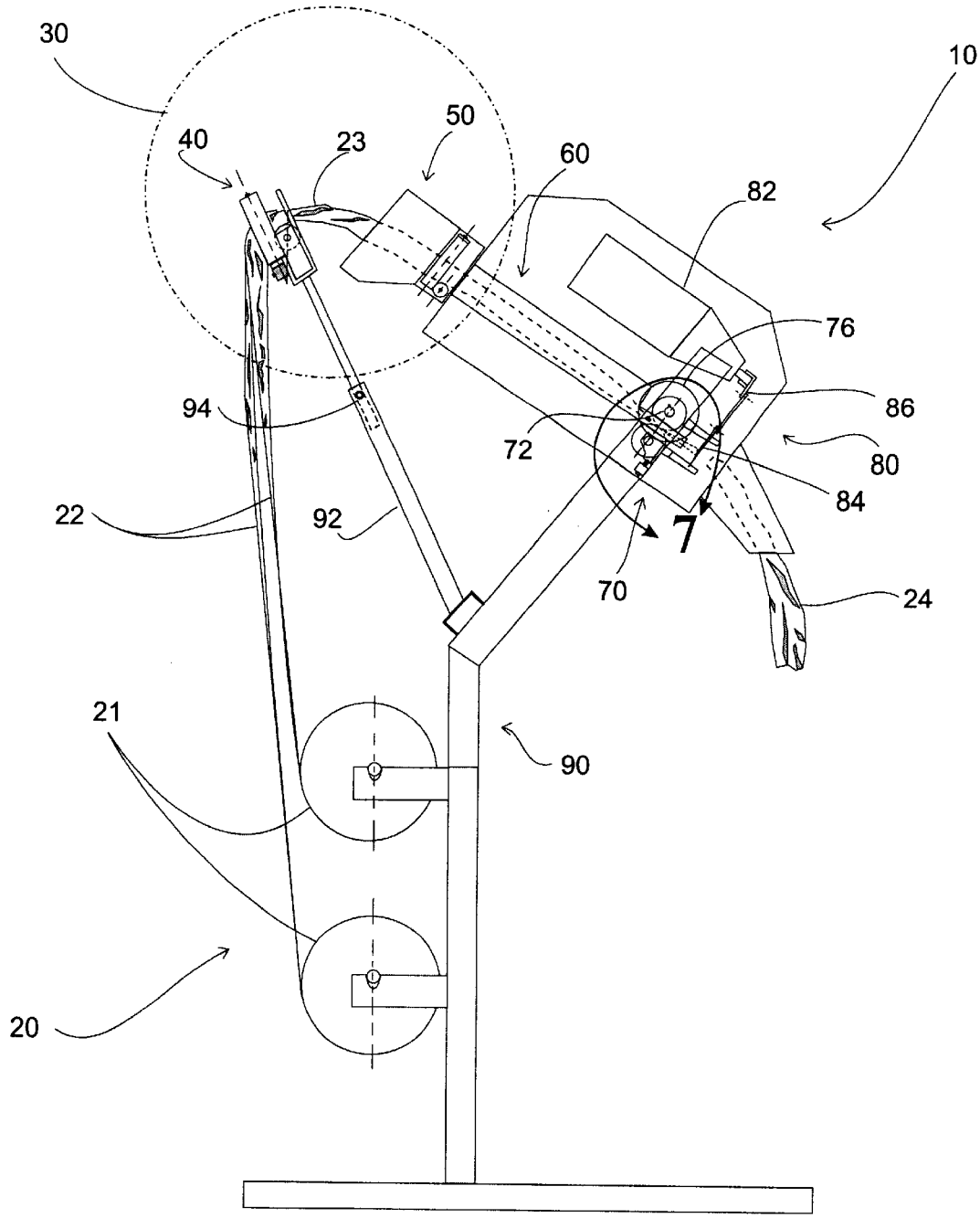
FIG. 1 is a side view of an embodiment of a paper conversion dispenser machine in accordance with the present invention shown in the working position.
Figure 2:
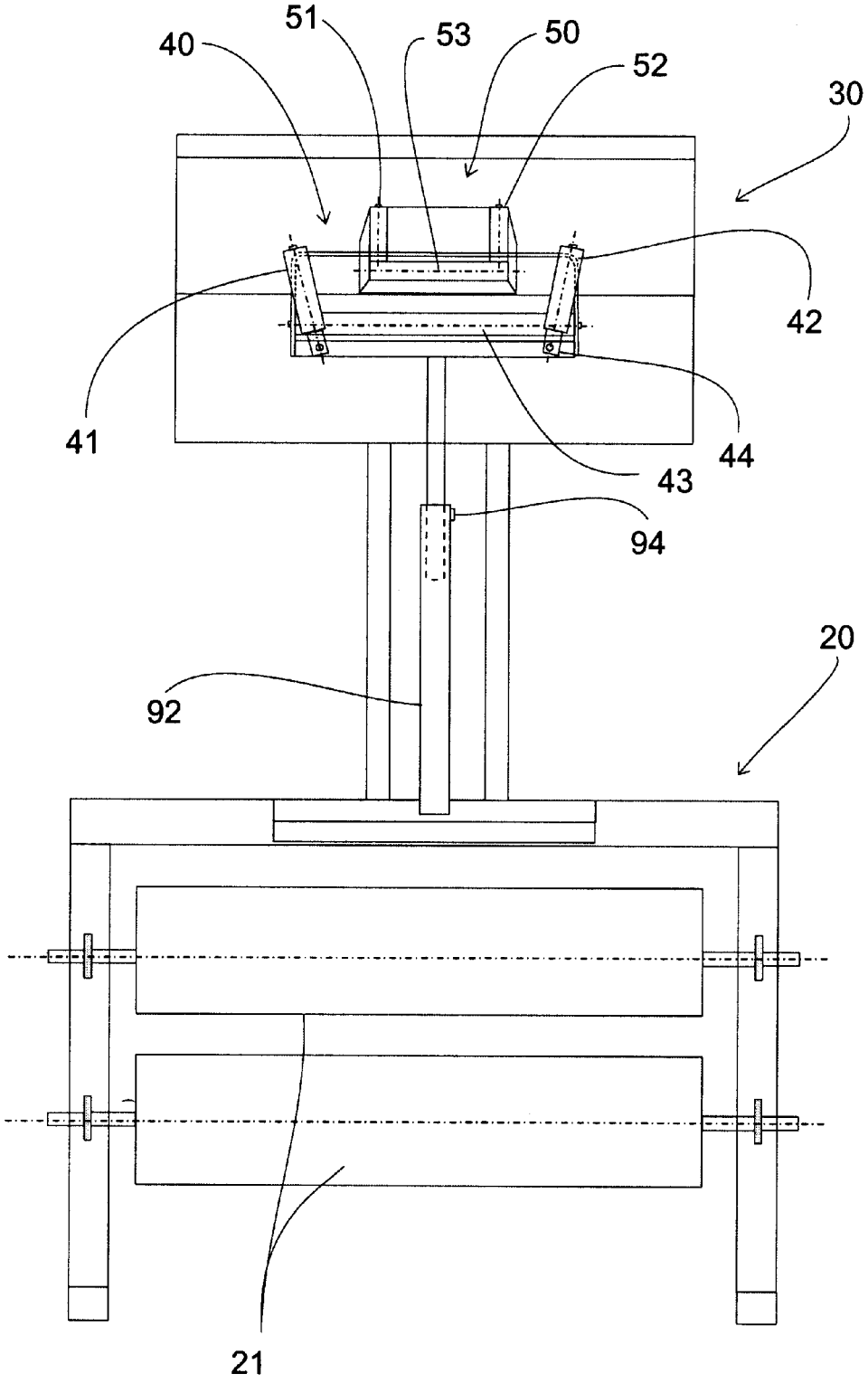
FIG. 2 is a back view of the embodiment of FIG. 1 showing the pre-entry and the entry sections without paper sheet being fed.
Figure 3:
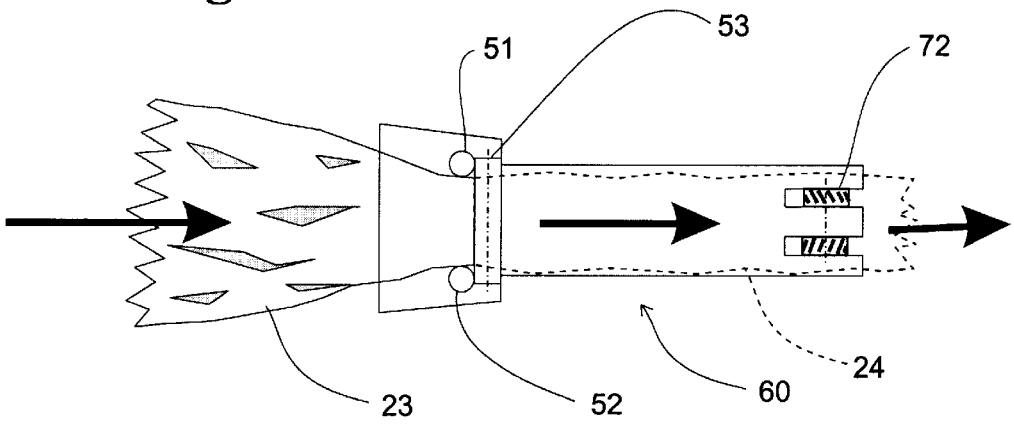
FIG. 3 is a partial top view of the shaping member that consists of the entry section, together with the guiding tunnel and the feed mechanism of the embodiment of FIG. 1.

Referring to FIGS. 1 and 2, there is shown an embodiment of a paper conversion dispenser machine according to the present invention generally indicated by reference numeral 10. The machine 10 converts a stock sheet-like material 22 into a continuous three-dimensional shape crumpled stream 23 of relatively low density cushioning dunnage product 24. The machine 10 is shown positioned standing vertical and includes a stock supplying assembly 20 with two stock paper rolls 21, a shaping member 30 that consists of a pre-entry section 40 followed by an entry section 50, a guiding tunnel 60, a feed mechanism 70, a cutting set 80, and a frame 90.

Figure 4:
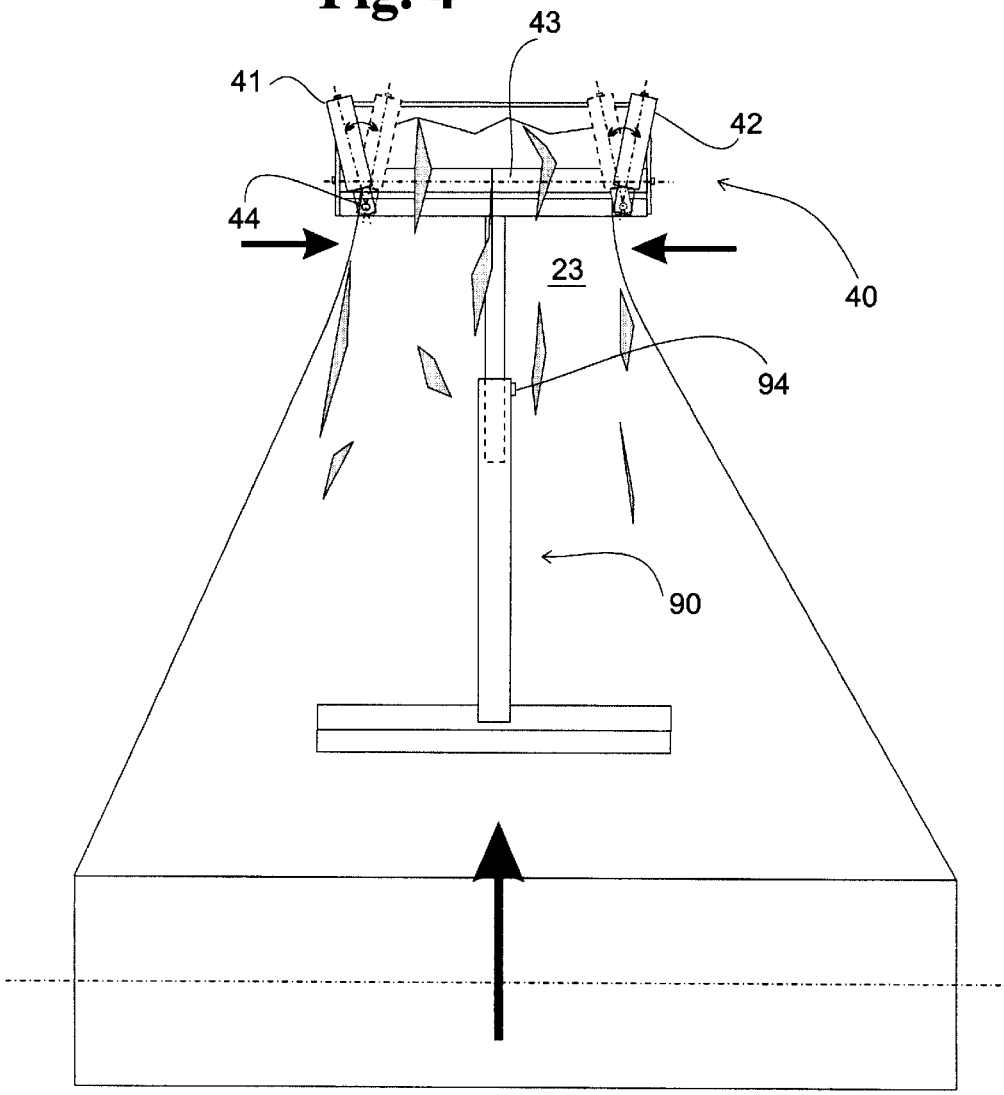
FIG. 4 is an enlarged back view of the embodiment of FIG. 1 showing pre-entry section with the paper sheet being fed therein.
Figure 5:
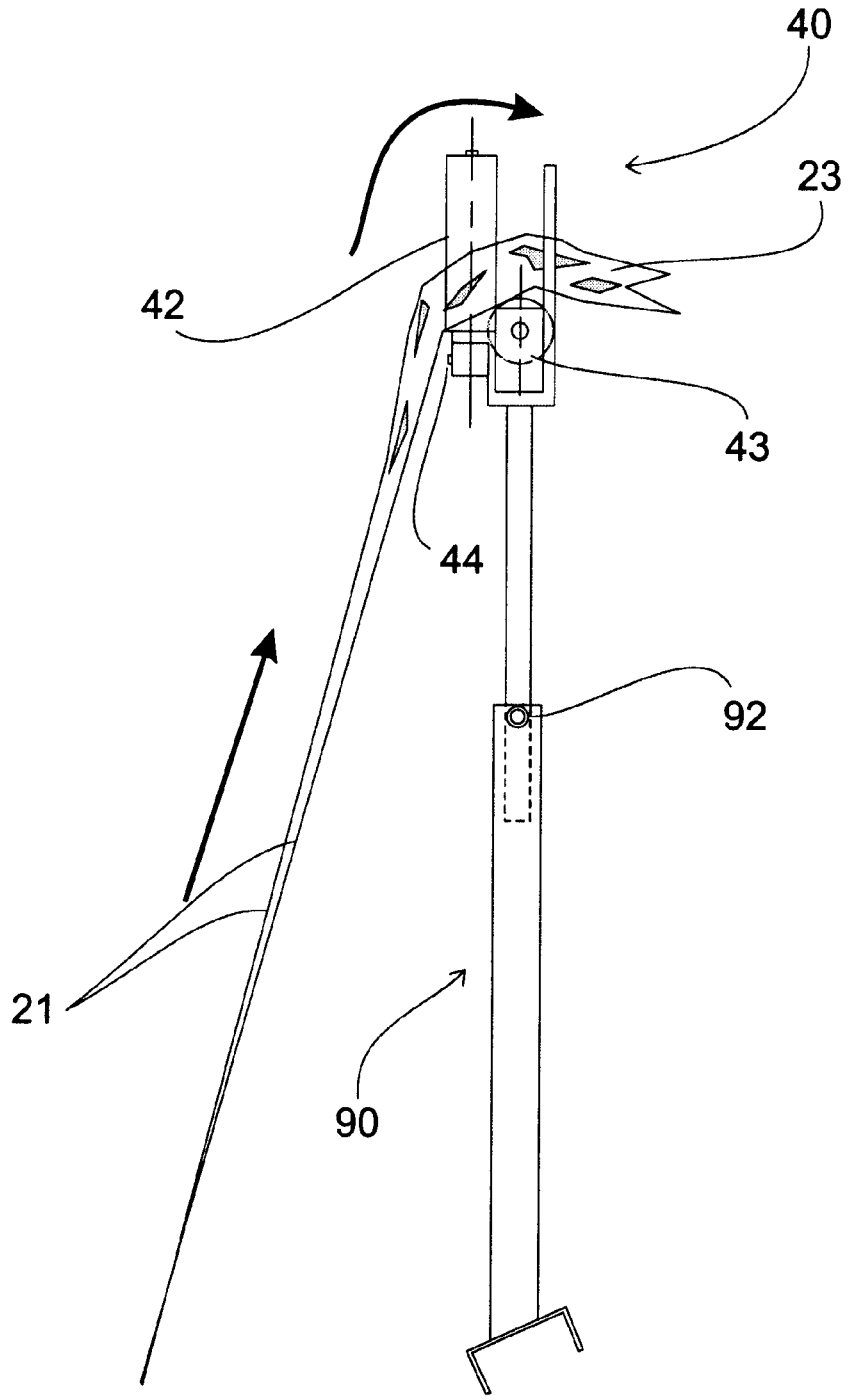
FIG. 5 is a side view on the pre-entry section of FIG. 4.
Figure 6:
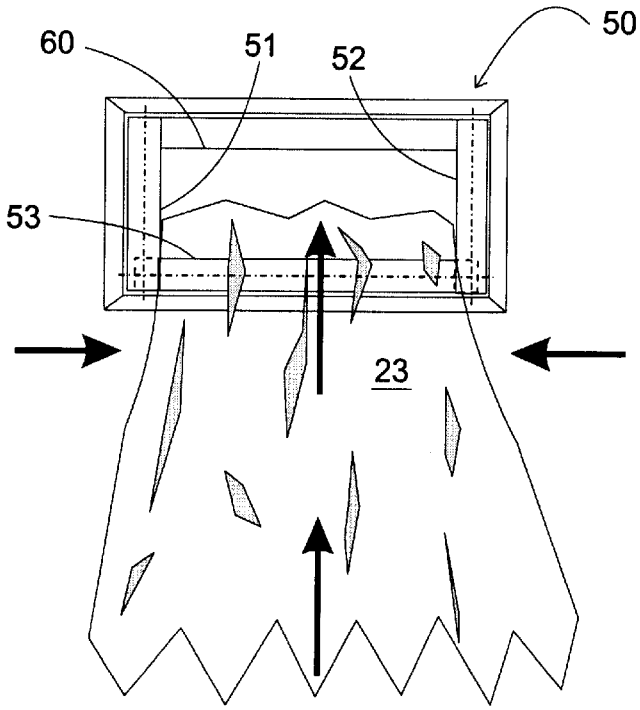
FIG. 6 is an enlarged back view of the entry section of the embodiment of FIG. 1.

As shown in FIGS. 4 to 6, the pre-entry section 40 comprises two side entry guiding rollers 41, 42 having a substantially vertical axis and a bottom mounted roller 43 having a substantially horizontal axis. To better adjust to the paper quality, the two side entry guiding rollers 41, 42 have an inclination adjustment 44. Preferably, they are pivotally mounted at their lower end and secured in place via the adjustment 44, preferably a screw, to be adjusted within a plane defined by the two axis of the rollers 41, 42.

As shown in FIGS. 1, 2, 4 and 5, the pre-entry section 40 is preferably slidably connected to the frame 90 via an attachment member 92. The latter preferably has a tightening screw 94 that allows for fixing the pre-entry section 40 at the required position. Furthermore, and with particular reference to FIG. 6, the entry section 50 also preferably consists of two side entry guiding rollers 51, 52 and a bottom mounted roller 53 having a substantially vertical and horizontal axis respectively.

Figure 7:
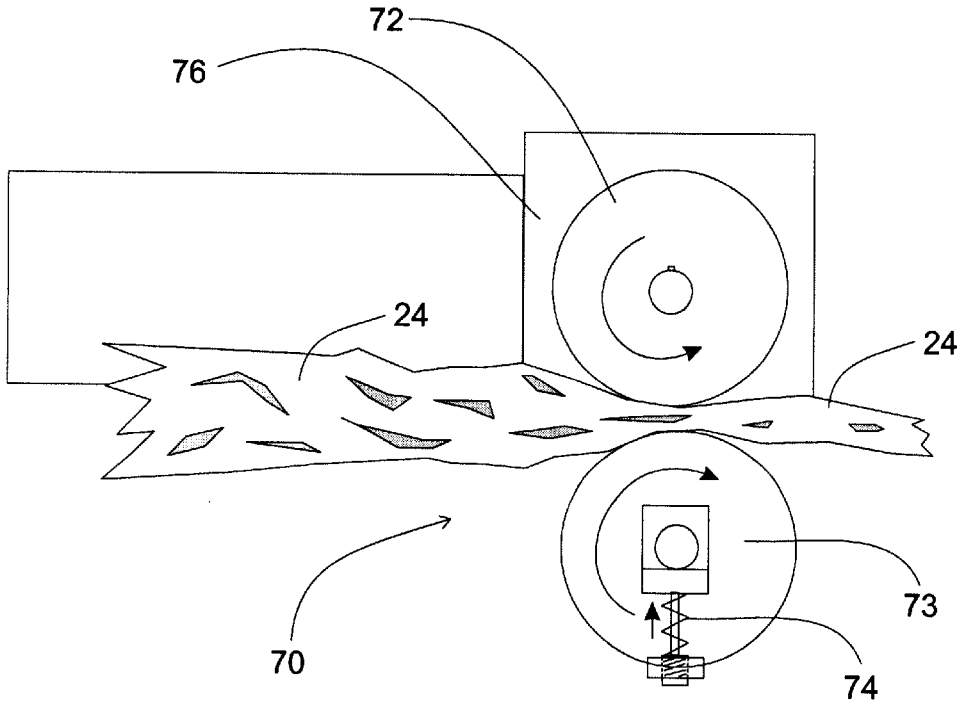
FIG. 7 is an enlarged sectional view taken along line 7 of FIG. 1, showing the feed mechanism.

As shown in FIG. 7, the feed mechanism 70 drives the stock material 22 within the shaping member 30 and includes a motor 76 connected to a driving roller 72 and a driven roller 73 spring biased against the driving roller 72 via spring 74. Rollers 72, 73 are preferably made out of two coaxial wheels each, and are adapted to frictionally receive the dunnage product 24 there between. Specifically, when sheet of paper 22 is pulled by the rollers 72, 73 of the feed mechanism 70 through pre-entry and entry sections 40, 50, the paper 22 is crumpled to form dunnage 24.

In the pre-entry section 40, the width of single or double ply stock paper 22 is preferably reduced by 70% into a narrower non-linear crumpled stream 23 of paper, from 30" to 10" approximately. The entry section 50 preferably reduces the width of the crumpled stream 23 even narrower by an additional 30%, from 10" to 7" approximately, to a relatively low density cushioning dunnage product 24. Two side entry guiding rollers 41, 42 and bottom mounted roller 43 of the pre-entry section 40, as well as the two side entry guiding rollers 51, 52 and the bottom mounted roller 53 of the entry section 50 are preferably mounted on bearings for free rotational movement around their respective axis. Rollers 41, 42, 43, 51, 52 and 53 are substantially so machined to provide a non-frictional surface finish and are preferably covered with an anti-friction material. It is also possible to slightly modify the shape of the dunnage product 24 by changing the inclination of the side rollers 41, 42 using the screw of the inclination adjustment 44.

The pre-entry section 40 can be slidably adjusted to the required position by the attachment member 92 and the screw 94 to ensure optimal conditions of the cushioning dunnage product 24 movement for specific paper roll 21 quality and production rate. After the entry section 50, the cushioning dunnage product 24 moves through the guiding tunnel 60 to the set of driving 72 and driven 73 rollers of the feed mechanism 70 to be pushed to the cutting set 80 for cutting of the same and directly dispensing it into a shipping case or box containing products (not shown). The cutting set 80 preferably includes a sliding blade 84 driven by a second motor 82 via a cam mechanism 86.

The paper conversion dispenser machine 10 of the present invention converts the sheet-like material 22 into a relatively low density cushioning dunnage product 24 with minimal friction, is extremely reliable to use and enables the production of cushioning dunnage product 24 at relatively high rate, without damaging the paper 22.

It will be understood that the embodiment described herein is merely exemplary and that a person skilled in the art may make many variations, combinations and modifications without departing from the spirit and the scope of the invention. All such modifications and variations are intended to be included within the scope of the invention as defined in the appended claims.

We claim:

1. A paper conversion dispenser machine for converting paper sheet material into a relatively low density cushioning dunnage product, said machine comprising:

a frame adapted to support a stock supplying assembly for supplying at least one stock paper roll;

a shaping member for crumpling and converting paper sheet material of said roll into a three-dimensional shape, said paper sheet material having a surface and two edges, said shaping member including a pre-entry section with two side entry guiding rollers each roller being transverse to each side edge of the paper sheet material and having an axis that is perpendicular to the surface of said paper sheet material for guiding and reducing in width said paper sheet material of a supplied width to a narrower width non linear crumpled stream of paper, said stream of paper having a surface and two side edges, and an entry section with two side entry rollers, each roller of the entry section being transverse to each side edge of the stream of paper and having an axis that is perpendicular to the surface of the stream of paper for guiding and reducing in width said crumpled stream of paper down to an even narrower width relatively low density cushioning dunnage product, said entry section being spaced downstream from the pre-entry section;

a guiding tunnel having a substantially uniform cross section for guiding the dunnage product received from the entry section, said guiding tunnel being positioned downstream from the entry section;

a feed mechanism positioned at an exit of said guiding tunnel for driving said stock paper roll through said shaping member, said feed mechanism including first and second sets of driving and driven rollers adapted to frictionally receive said dunnage product therebetween near both edges of the dunnage product, thereby reducing in thickness said edges of said dunnage product; and a cutting set for cutting said dunnage product.

2. A dispenser machine according to claim 1, wherein each of said side entry guiding rollers is pivotally mounted at a lower end to allow for inclination adjustment of the same both edges of said crumpled stream of paper.

3. A dispenser machine according to claim 1, wherein said pre-entry section further includes a bottom mounted roller guiding a bottom face of said crumpled stream of paper.

4. A dispenser machine according to claim 3, wherein said rollers are covered with an anti-friction material.

5. A dispenser machine according to claim 1, wherein each of said pre-entry and entry sections includes a bottom mounted roller guiding a bottom face of said crumpled stream of paper.

6. A dispenser machine according to claim 5, wherein said rollers are covered with anti-friction material.

7. A dispenser machine according to claim 5, wherein said driven roller is spring biased against said driving roller.

8. A dispenser machine according to claim 1, wherein said driven roller is spring biased against said driving roller.

9. A dispenser machine according to claim 1, wherein said pre-entry section is slidably mounted to said frame via an attachment member.

10. A dispenser machine according to claim 5, wherein each of said driving and driven roller is made out of two coaxial wheels.

11. A dispenser machine according to claim 1, wherein said stock supplying assembly includes two stock paper rolls parallel to each other.

12. A dispenser machine according to claim 5, wherein said pre-entry and entry sections reduce said at least one stock paper roll entering the same by approximately 70% and 30% in width respectively.

* * * * *